United States Patent [19]

Bies

[11] Patent Number: 5,056,263

[45] Date of Patent: Oct. 15, 1991

[54] SELF-POSITIONING AND SELF-LOCKING DOOR SWEEP AND DOOR ASSEMBLY THEREWITH

[75] Inventor: Sylvester W. Bies, Lake Orion, Mich.

[73] Assignee: The Stanley Works, New Britain, Conn.

[21] Appl. No.: 642,421

[22] Filed: Jan. 17, 1991

[51] Int. Cl.[5] ..... E06B 7/16

[52] U.S. Cl. ..... 49/488; 49/470; 49/476; 49/489

[58] Field of Search ..... 49/488, 489, 470, 476

[56] References Cited

U.S. PATENT DOCUMENTS

| | | | |
|---|---|---|---|
| 2,568,477 | 9/1951 | Westlund . | |
| 2,934,802 | 5/1960 | Shekter . | |
| 3,064,319 | 11/1962 | Miller . | |
| 4,006,562 | 2/1977 | Belanger et al. | 49/470 X |
| 4,015,368 | 4/1977 | Court et al. | 49/489 X |
| 4,034,511 | 7/1977 | Bursk . | |
| 4,119,325 | 10/1978 | Oakley et al. | 49/488 X |
| 4,310,991 | 1/1982 | Seely | 49/470 |
| 4,447,989 | 5/1984 | Mailand et al. . | |
| 4,712,331 | 12/1987 | Fujiwara . | |
| 4,850,144 | 7/1989 | Grisham et al. . | |

FOREIGN PATENT DOCUMENTS

| | | | |
|---|---|---|---|
| 512986 | 10/1939 | United Kingdom | 49/488 |

*Primary Examiner*—Philip C. Kannan

[57] ABSTRACT

A door has horizontally extending channels in each face adjacent its bottom edge which rest an integrally formed bottom seal and sweep member. The seal member has a body portion with a horizontally disposed transverse wall extending along the bottom edge of the door, upstanding side walls extending along the faces of the door, and generally horizontally and inwardly extending flanges at their upper ends which extend into the door channels. The seal member also has a plurality of depending elements to seal the spacing between the door and threshold, and the channels and flanges have cooperating positioning elements thereon to secure the seal and sweep member in a fixed and predetermined position on the door.

13 Claims, 2 Drawing Sheets

58
35
60
36
24
34
32
30
28
27b
20
27a
26a
29
46
50
52
56
6
48
10
54
18
14
26b

SELF-POSITIONING AND SELF-LOCKING DOOR SWEEP AND DOOR ASSEMBLY THEREWITH

BACKGROUND OF THE INVENTION

The present invention relates to doors and, more particularly, to door assemblies having a door sweep or seal along the bottom edge.

As is well known, it is desirable to provide weatherstripping and sealing elements on the edges of entry doors to minimize the passage of air thereby and the intrusion of rain and dirt into the interior of the building. Accordingly, it is customary to provide some form of weatherstripping element along the latch side of the door and a sealing element along the bottom edge of the door to make sealing contact with the threshold or sill.

The typical sealing element for the bottom edge of the door is a sweep with at least one depending and resiliently deflectable leg which will bridge the gap between the bottom edge of the door and the top surface of the sill or threshold. Generally, two or more depending elements are provided and they are of longer dimension than the spacing so that they will be deflected and sweep the surface of the sill or threshold during the closing motion. Some sweeps and seals have a still longer depending leg which will seal against the interior face of the sill.

Such bottom sweeps and seals are frequently secured by screws or nails driven into the bottom edge of the door or to the face of the door adjacent the bottom edge. In some instances, a channel may be routed or otherwise formed in the bottom edge of the door into which a resiliently compressible arm on the sweep is inserted to frictionally retain the sweep on the door.

Although a wide variety of sweeps or seals may be employed in connection with wooden doors and mounted thereof by fasteners, doors with synthetic resin or metal skins generally require special structures on the skins to seat the bottom sweep, or a special construction for the sweep. As a result, some entry doors employing metal and plastic skins are sold with the sweep assembled in place and this can present a substantial problem from the standpoint of replacement of a sweep which may become worn or damaged. Moreover, the use of mechanical fastening elements or adhesives can be detrimental to the life of synthetic plastic skins.

It is an object of the present invention to provide a novel entry door sweep which can be readily assembled to the bottom of a cooperating entry door and readily replaced in the event that it is damaged or deteriorates.

It is also an object to provide a door assembly with such a sweep which firmly seats upon the door without fasteners and is self-positioning to ensure its proper location along the bottom edge of the door.

Another object is to provide a door assembly with such a sweep which is readily reversible to enable reversal of the door opening direction while maintaining desirable sealing action.

Still another other object is to provide a door assembly employing such a sweep which will exhibit relatively long life and in which the mounting of the sweep will not affect deterioration of or injury to the bottom edge of the door.

SUMMARY OF THE INVENTION

It has now been found that the foregoing and related objects may be readily attained in a door assembly including a door having horizontally extending channels in each face adjacent the bottom edge thereof. Seated on the bottom edge portion of the door is an integrally formed bottom seal and sweep member having a body portion with a horizontally disposed transverse wall extending along the bottom edge of the door. The sweep member has upstanding side walls extending along the faces of the door, and horizontally and inwardly extending flanges at their upper ends which extend into the channels of the door. The bottom sweep and seal member also has a plurality of elements depending from the transverse wall to close the spacing between the bottom edge of the door and the associated threshold, and the channels of the door and the flanges of the seal and sweep member have cooperating positioning means thereon to secure the seal and sweep member in position on the door.

Preferably, each of the channels in the door includes an tapered ramp portion at one end thereof, and the ramp portions are disposed adjacent the opposite edges of the door. The positioning means includes a transversely extending shoulder on the door in each channel adjacent an end thereof, and the shoulders of the two flanges are disposed adjacent opposite edges of the door. The flanges also have end portions providing transversely extending shoulders abutting the transversely extending shoulders of their channels.

The tapered ramp portion extends from the edge of the door to adjacent the shoulders of the channels to allow the flanges to facilitate movement of the flanges into the channels beyond the horizontal shoulders thereof. The end portion of the flange opposite that end having the shoulders has a tapered surface to facilitate insertion of the bottom seal and sweep member into the channels.

The depending elements include a depending, resiliently deflectable finger adjacent one face of the door and a box-like element adjacent the other face.

DETAILED DESCRIPTION OF PREFERRED EMBODIMENT OF THE INVENTION

Figure 1:
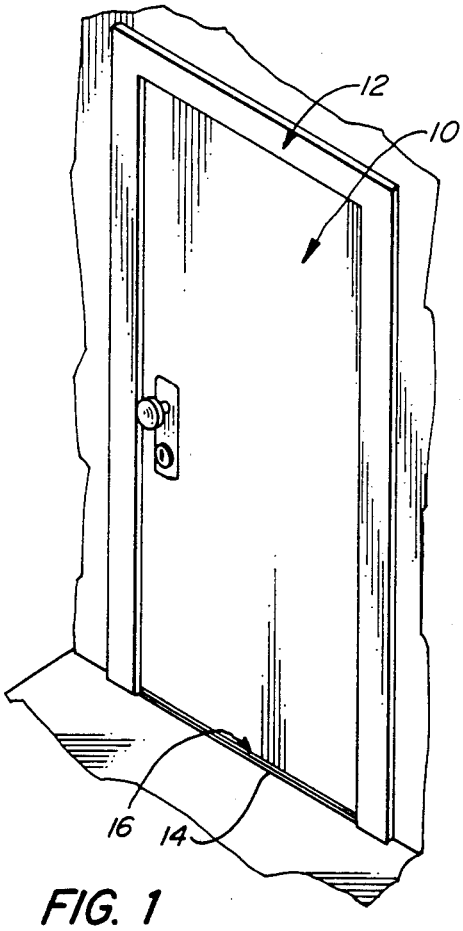
FIG. 1 is a fragmentary prespective view of a wall having a door installation embodying the present invention.
Figure 2:
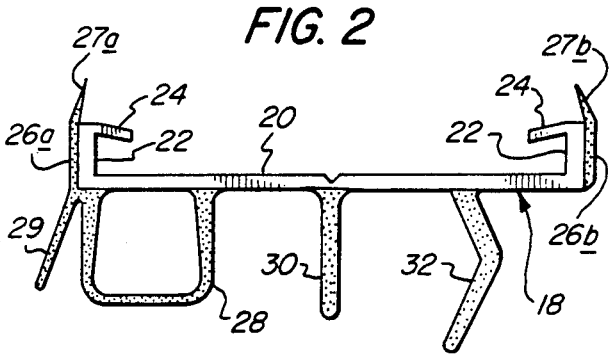
FIG. 2 is an end elevational view of a self-locking and positioning door sweep of the present invention.

Turning first to FIG. 1 of the attached drawings, therein illustrated is a door assembly embodying the present invention including a door generally designated by the numeral 10 pivotally mounted within the door frame generally designated by the numeral 12, a threshold 14, and a sweep generally designated by the numeral 16 which acts against the threshold 14 to effect a seal along the bottom edge of the door 10.

Turning next to FIGS. 2–7 of the drawings, the sweep 16 of the present invention has a generally U-shaped body portion 18 with a transverse wall 20 and vertical side walls 22, and opposed, inwardly extending and generally horizontal flanges 24 at the upper ends of the side walls 22. Extending upwardly along the outer faces of the side walls 22 are sealing flaps 26 which have an inwardly inclined wiper portion 27 adapted to resiliently bear against the face of the door 10. The outer sealing flap 26*a* also has a depending and outwardly inclined leg 29.

Figure 3:
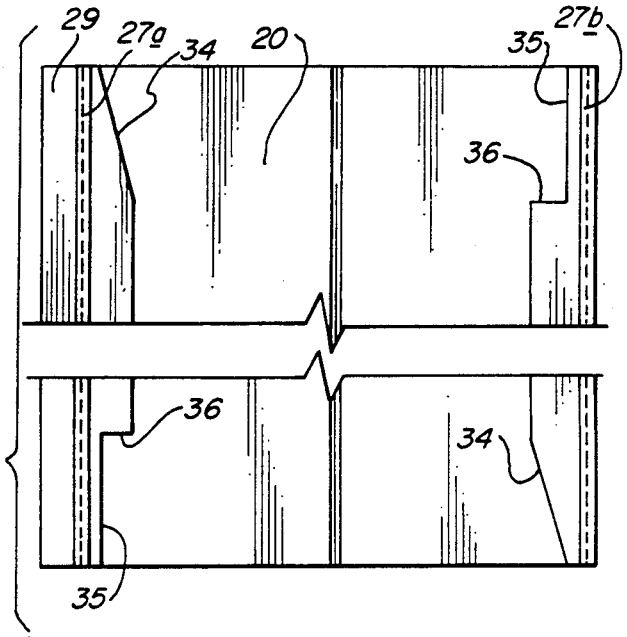
FIG. 3 is a fragmentary top plan view thereof.
Figure 4:
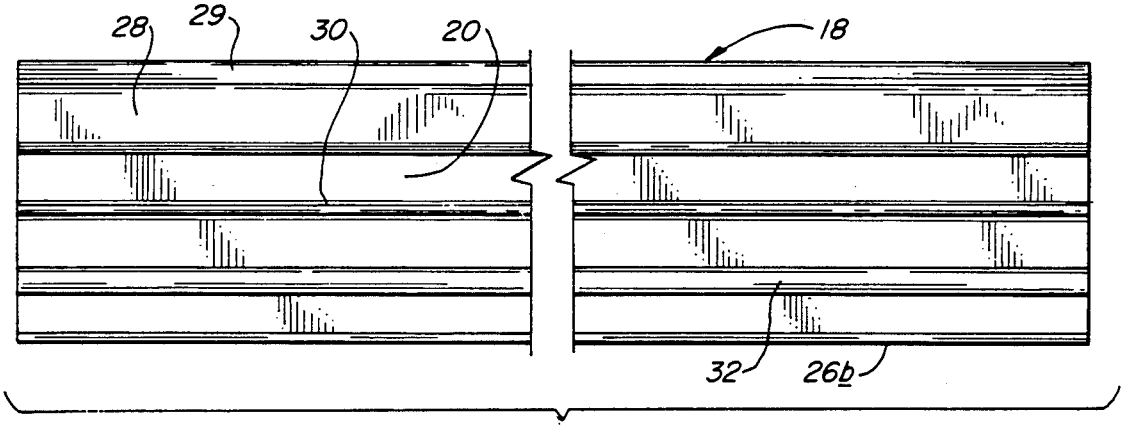
FIG. 4 is a fragmentary bottom plan view thereof.
Figures 5, 6, 7:
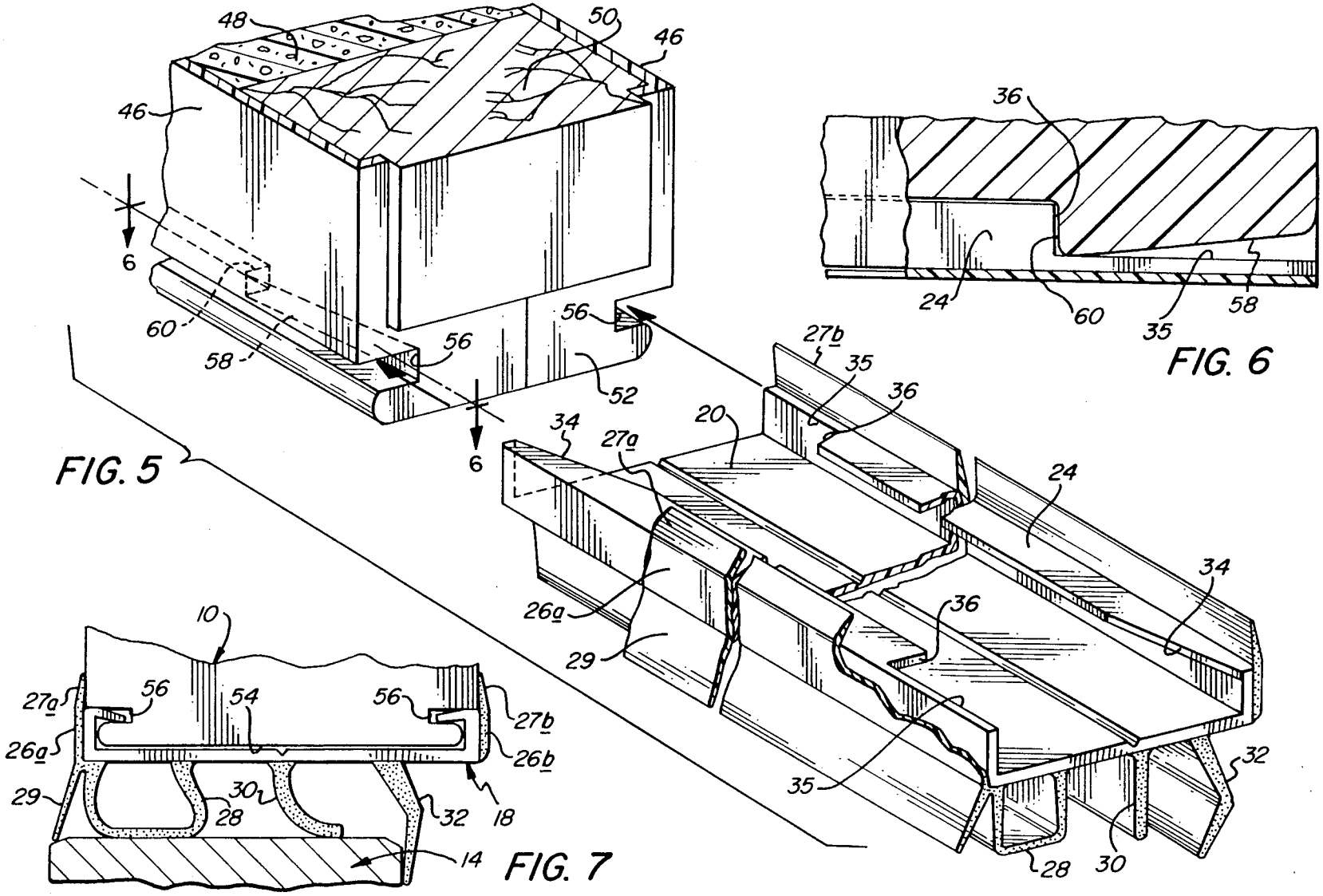
FIG. 5 is a partially exploded fragmentary perspective view of the bottom edge portion of the door and sweep of the present invention.
FIG. 6 is a fragmentary sectional view of the assembly along the line 6—6 of FIG. 5.
FIG. 7 is a fragmentary end elevational view of the bottom edge portion of the door and sweep as positioned over the threshold in the closed position of FIG. 1.

Depending from the transverse wall 20 are a box seal 28 adjacent the side of the sweep 16 which is to be disposed towards the outside of the building, an intermediate sealing leg 30, and an arched sealing leg 32 adapted to abut and extend along the inside edge of the door sill 14. As seen in FIGS. 3 and 5–6, each of the flanges 24 has a tapered ramp surface 34 at one end, and the opposite end of each flanges 24 has notch 35 therein to provide a horizontally extending shoulder 36. As seen, the disposition of the notch 35 and tapered ramp surface 34 are reversed in the two flanges 24 relative to the length of the sweep 16.

Turning now to the door construction as seen in FIGS. 5 and 6, the outer and inner skins 46 of the door 10 receive therebetween stiles 50 along each side and a synthetic resin insulating core 48. The skins 46 have opposed bottom flanges 52 which provide the bottom portion 54 of the door and which are molded with horizontally extending channels 56 in their outer surfaces. Each of the channels 56 has a ramp portion 58 at one end thereof which is both vertically and horizontally tapered to facilitate entry of the flange 24 thereinto and outward deflection of the flange 24 and its associated side wall 22. At the end of the tapered portion 58, the channel 56 abruptly returns to its normal depth and width, and this provides a horizontal shoulder 60.

As assembled, the shoulders 36 of the sweep 16 abut the shoulders 60 of the channels 56, and the oriented of the shoulders is reversed in the two channels so that there is a locking action in both longitudinal directions. As seen in FIG. 7, the box seal 28, intermediate leg 30 and arched leg 32 are all of greater dimension than the spacing between the bottom edge of the door 10 and the sill 14, and they are deflected by the closing of the door 10. The memory inherent in the resin from which they are fabricated produces a sealing action against the surface of the sill 14. The wiper portions 27 of the sealing flaps 26 similarly seal tightly against their respective faces of the door 10, and the inclined leg 29 generally directs water descending on the face of the door 10 towards the outside of the thresholds 14.

In assembling the sweep 16 to the door 10, the sweep 16 is oriented with the box seal 28 adjacent what is to the the outer face of the door 10 and the flanges 24 are introduced into the channels 56 in the bottom flanges 52 of the skins 46. The ramp surface 34 slides along the ramp portion 58 of the channel 56 and the increasing dimension of the ramp portion 58 will cause the flanges 24 to spread apart. After the shoulder 36 passes the shoulder 60, the memory of the synthetic resin used to fabricate the sweep 16 causes the flanges 24 to deflect inwardly, aligning the shoulder 36 with the shoulder 60 in the channel 56. At the same time, the shoulder 36 of the other flange 24 abuts against the shoulder 60 of the other channel 56. As a result, the sweep 16 is positively located and held in place due to the opposing shoulders 36, 60 and the biasing action of synthetic resin sidewalls and flanges of the sweep 16.

If it is desired to remove the bottom sweep 16, pliers or the like may be used to grip one end, and sufficient pulling force will cause the side walls and flanges to spread apart to enable the sweep 16 to pulled from the bottom of the door 10.

As indicated above, the sweep 16 is fabricated from synthetic resin, and generally it is desirable to extrude the sweep from dual durometer resins. As indicated by the stippling in FIG. 2, the elements other than the body portion 18 are fabricated from a relatively low durometer or flexible resin formulation while the body portion 18 is fabricated from a higher durometer or more rigid resin formulation. Accordingly, those elements which must flex repeatedly or for extended periods of time exhibit a high degree of resiliency and lower creep.

As will be appreciated, the actual configuration of the sealing elements provided on the sweep can vary as can their number and placement. However, it is generally desirable to have at least one sealing element which will deflect and seal tightly against the top surface of the threshold and another depending element which will seal tightly against a vertical face of the threshold to minimize the passage of air and water and dust under the door.

Although the sweep has been shown as used on a door with synthetic resin skins, it will be appreciated that the present invention is also applicable to doors with metal and composite skins and to solid wood doors and to doors of other composite construction. It is only essential that the door construction provide the channels required to cooperate with the sweep and snugly seat it.

Thus, it can be readily seen from the foregoing detailed specification and the attached drawings that the door assembly of the present invention utilizes a sweep which may be quickly and firmly positioned along the bottom edge of the door without mechanical fasteners or adhesives, and it can be readily replaced in the event that it is damaged or deteriorates. The sweep is self-positioning and self-locking on the door to ensure proper location along the bottom edge of the door and it is readily reversible to enable reversal of the door opening direction while maintaining the desired sealing action.

Having thus described the invention, what is claimed is:

1. A door assembly including:

(a) a door with a pair of parallel faces and having horizontally extending channels in each of said faces adjacent the bottom edge of said door;

(b) an integrally formed bottom seal and sweep member having a body portion with a horizontally disposed transverse wall extending along the bottom edge of said door, upstanding side walls extending along the faces of said door, and generally horizontally and inwardly extending flanges at the upper ends of said side walls, said flanges extending into said channels of said door, said bottom sweep and seal member also having a plurality of elements depending from said transverse wall to close the space between the bottom edge of said door and the associated threshold, said channels of said door and said flanges of said seal and sweep member having cooperating and interengaging positioning means thereon to secure said seal and sweep member in a predetermined position along the length of said channels against inadvertent longitudinal movement on said door.

2. The door assembly in accordance with claim 1 wherein at least one of said channels in said door includes a tapered horizontally inwardly inclined ramp portion only adjacent one end thereof.

3. The door assembly in accordance with claim 1 wherein ramp portions are provided in both of said channels, said ramp portions being disposed adjacent the opposite edges of said door.

4. The door assembly in accordance with claim 1 wherein said positioning means includes a horizontally extending shoulder on said door in each channel adjacent an end thereof, said shoulder being disposed adjacent the opposite edges of said door said flanges of said seal and sweep member having an end portion providing a horizontally extending shoulder abutting said horizontally extending shoulder of its channel.

5. The door assembly in accordance with claim 4 wherein each of said channels in said door includes a tapered ramp portion extending from the edge of said door to adjacent the shoulder of its channel to facilitate movement of said flanges into said channels beyond said horizontal shoulders thereof.

6. The door assembly in accordance with claim 4 wherein the end portion of each flange opposite that end having said shoulder has a tapered surface to facilitate insertion of the bottom seal and sweep member into said channels.

7. The door assembly in accordance with claim 1 wherein said depending elements include a depending, resiliently deflectable finger adjacent one face of said door and a box-like element adjacent the other face.

8. An integrally formed bottom seal and sweep member having a body portion with a horizontally disposed transverse wall adapted to extend along the bottom edge of an associated door, upstanding side walls adapted to extend along the faces of the door, and generally horizontally and inwardly extending flanges at the upper ends of said side walls, said flanges being adapted to extend into horizontally extending channels formed in the faces of the door adjacent its bottom edge, said bottom sweep and seal member also having a plurality of elements depending from said transverse wall adapted to close the spacing between the associated door and its threshold, said flanges of said seal and sweep member having positioning means thereon adapted to engage cooperating and interengaging positioning members in the channels of the associated door to secure said seal and sweep member in a predetermined position along the length of the channels against inadvertent longitudinal movement on the associated door.

9. The integrally formed seal and sweep member in accordance with claim 8 wherein said flanges of said seal and sweep member have an end portion providing a horizontally extending shoulder adapted to abut a horizontally extending shoulder in the channel of the associated door.

10. The integrally formed seal and sweep member in accordance with claim 9 wherein the end portion of each flange opposite that end having said shoulder has a tapered surface to facilitate insertion of the bottom seal and sweep member into the channels of the associated door.

11. The integrally formed seal and sweep member in accordance with claim 8 wherein said depending elements include a depending, resiliently deflectable finger adjacent one longitudinal edge thereof and a box-like element adjacent the other longitudinal edge.

12. A door assembly including:

(a) a door having horizontally extending channels in each face adjacent the bottom edge thereof;

(b) an integrally formed bottom seal and sweep member having a body portion with a horizontally disposed transverse wall extending along the bottom edge of said door, upstanding side walls extending along the faces of said door, and generally horizontally and inwardly extending flanges at the upper ends of said side walls, said flanges extending into said channels of said door, said bottom sweep and seal member also having a plurality of elements depending from said transverse wall to close the space between the bottom edge of said door and the associated threshold, said channels of said door and said flanges of said seal and sweep member having cooperating positioning means thereon to secure said seal and sweep member in position on said door, said positioning means including a horizontally extending shoulder on said door in each channel adjacent an end thereof, said shoulder being disposed adjacent the opposite edges of said door, said flanges of said seal and sweep member having an end portion providing a horizontally extending shoulder abutting said horizontally extending shoulder of its channel.

13. An integrally formed bottom seal and sweep member having a body portion with a horizontally disposed transverse wall adapted to extend along the bottom edge of an associated door, upstanding side walls adapted to extend along the faces of the door, and generally horizontally and inwardly extending flanges at the upper ends of said side walls, said flanges being adapted to extend into horizontally extending channels formed in the faces of the door adjacent its bottom edge, said bottom sweep and seal member also having a plurality of elements depending from said transverse wall adapted to close the spacing between the associated door and its threshold, said flanges of said seal and sweep member having positioning means thereon adapted to engage cooperating positioning members in the channels of the associated door to secure said seal and sweep member in a position on the associated door, said flanges of said seal and sweep member having an end portion providing a horizontally extending shoulder adapted to abut a horizontally extending shoulder in the channel of the associated door.

* * * * *